US005695325A

United States Patent [19]

Sperry

[11] Patent Number: 5,695,325

[45] Date of Patent: Dec. 9, 1997

[54] SYNCHRONIZED UNLOADER SYSTEM AND METHOD FOR A GAS COMPRESSOR

[76] Inventor: Lauren D. Sperry, 1112 S. 17th St., Blue Springs, Mo. 64015

[21] Appl. No.: 538,895

[22] Filed: Oct. 4, 1995

[51] Int. Cl.[6] ..... F04B 81/00

[52] U.S. Cl. ..... 417/53; 417/443; 417/446

[58] Field of Search ..... 417/443, 446, 417/53

[56] References Cited

U.S. PATENT DOCUMENTS

| | | | |
|---|---|---|---|
| 311,147 | 1/1885 | Richardson . | |
| 979,811 | 12/1910 | Wallem . | |
| 1,475,826 | 11/1923 | Hoffman . | |
| 2,037,140 | 4/1936 | Nathan | 417/446 |
| 2,066,860 | 1/1937 | Shumake | 417/443 |
| 2,243,888 | 6/1941 | Shelly | 417/443 X |
| 3,275,032 | 9/1966 | Gruller . | |
| 3,455,335 | 7/1969 | Pekarek . | |
| 3,602,247 | 8/1971 | Bunn et al. . | |
| 3,653,783 | 4/1972 | Sauder | 417/446 X |
| 3,704,079 | 11/1972 | Berlyn | 417/443 X |
| 3,777,776 | 12/1973 | Boisserand . | |
| 3,794,063 | 2/1974 | Carroll et al. . | |
| 3,917,220 | 11/1975 | Gilmore . | |
| 3,990,475 | 11/1976 | Myers . | |
| 4,043,710 | 8/1977 | Bunn et al. . | |
| 4,445,824 | 5/1984 | Bunn et al. . | |
| 4,447,193 | 5/1984 | Bunn et al. . | |
| 4,471,809 | 9/1984 | Thomsen et al. . | |
| 4,802,621 | 2/1989 | Standke . | |
| 4,823,842 | 4/1989 | Toliusis . | |
| 4,971,115 | 11/1990 | Tinholt . | |
| 5,011,112 | 4/1991 | Glamm . | |
| 5,331,998 | 7/1994 | Sperry . | |

*Primary Examiner*—Richard E. Gluck
*Attorney, Agent, or Firm*—Litman, McMahon and Brown, L.L.C.

[57] ABSTRACT

An unloader system is provided for a gas compressor including a cylinder, a piston reciprocably mounted in the cylinder, a crankshaft connected to the piston and suction and discharge valve assemblies, selectively communicating the cylinder with suction and discharge lines. The compressor crankshaft is driven by a prime mover. The unloader system includes an unloader valve assembly, which can comprise one of the suction or discharge valve assemblies, and an unloader actuation system including a controller and a stepper motor. The unloader valve assembly includes a valve seat with a plurality of seat passages arrayed in a seat passage circle. The unloader actuation system rotates an unloader valve assembly guard and valve members mounted thereon in increments corresponding to the radial spacing of the valve members and the seat passages, with each incremental rotation corresponding to a single crankshaft revolution. A method of unloading a compressor includes the steps of arranging a plurality of valve members and seat passages in circles in an unloader valve assembly and incrementally rotating the valve guard in synchronization with the compressor crankshaft.

20 Claims, 11 Drawing Sheets

SYNCHRONIZED UNLOADER SYSTEM AND METHOD FOR A GAS COMPRESSOR

BACKGROUND OF THE INVENTION

1. Field of the Invention

The present invention relates generally to unloaders for reciprocating gas compressors, and in particular to an unloader system and method synchronized with the compressor crankshaft for providing essentially infinite step unloading.

2. Description of the Related Art

Gas compressors are well known and various types have been utilized to meet the requirements of particular applications. For example, natural gas transmission through pipelines is often accomplished with large, reciprocating compressors driven by internal combustion engines at pumping stations located along the pipeline routes.

In natural gas transmission, the internal combustion engines which drive the compressors are often fueled by natural gas. Thus, the fuel consumed by the compressors reduces the overall operating efficiency since the amount of gas delivered is reduced by amounts consumed in the transmission or pumping process.

Efficient operation of natural gas compressors typically involves the use of a computerized control system for controlling the air/fuel mixture, rotational speeds, etc. Another factor which has a significant effect on compressor operating efficiency relates to the extent to which the compressor is loaded. In fully-loaded operation, the maximum throughput of the compressor is achieved, with a resultant full load on the compressor engine. However, natural gas compressor flow demands can vary considerably, and typically depend on downstream demand factors and conditions.

Controlling compressor flow is often accomplished by "unloading" or partially unloading a compressor whereby each compressor stroke produces a reduced gas flow as compared to fully-loaded operation. Reduced gas flow generally corresponds to reduced work performed by the compressor engine, whereby fuel savings and greater efficiency can be achieved.

A previous method of unloading a compressor involves bypassing a suction valve and directly communicating the compressor cylinder to the suction line or suction chamber. Compression is thus prevented, or at least reduced, and the compressor is unloaded. Such a system is shown in the Bunn et al. U.S. Pat. No. 4,043,710.

A problem with such previous unloading methods wherein valve assemblies were either bypassed or maintained in closed positions relate to their lack of variable adjustment. Thus, many prior art devices tended to fully unload a compressor end, or provide no unloading at all.

Other previous methods of partially unloading a compressor include providing extra clearance space, for example, with a clearance bottle, for effectively increasing the clearance at a compressor end and thus reducing the gas flow therethrough.

Another method of unloading a compressor is disclosed in the Sperry U.S. Pat. No. 5,331,998, wherein the valve members, e.g., poppets, are shifted either laterally or rotationally with respect to a valve seat. The present invention relates to unloading the compressor in essentially infinite steps by rotating a valve guard mounting the valve members in synchronization with the compressor crankshaft. Heretofore there has not been available a gas compressor unloader system and method with the advantages and features of the present invention.

SUMMARY OF THE INVENTION

In the practice of the present invention, an unloader system is provided for a reciprocating gas compressor having a cylinder, a piston reciprocably mounted in the cylinder, a rotatable crankshaft connected to the piston, a suction valve assembly and a discharge valve assembly for selectively communicating suction and discharge lines with the compressor cylinder. An unloader valve assembly, which can comprise one of the suction discharge valve assemblies, includes a valve seat with multiple seat passages extending therethrough and arranged in a seat passage circle. A valve guard is rotatably mounted on the valve seat and includes a plurality of valve members arrayed in a valve circle and movable between open and closed positions with respect to the seat passages. An unloader actuation system includes a controller connected to a control system for the compressor and a stepper motor drivingly connected to the valve guard. A method of unloading the compressor includes the steps of incrementally rotating the valve guard in synchronization with the compressor crankshaft by increments corresponding to the radial spacing between the valve members and the seat passages. The closings of the valve members are delayed by varying amounts to achieve varying amounts of unloading.

OBJECTS AND ADVANTAGES OF THE INVENTION

The principle objects and advantages of the present invention include: providing an unloader system for a gas compressor; providing such an unloader system which is synchronized with the compressor; providing such an unloader system which utilizes a compressor control system for providing signals for actuating the unloader system; providing such an unloader system which provides essentially infinite step unloading capabilities; providing such an unloader system which can be utilized with various types of valve assemblies; providing such an unloader system which can be utilized with suction and discharge valve assemblies; providing such an unloader system which can be utilized with radial, single deck, double deck and other types of valve assemblies; providing such an unloader system which can be utilized with a clearance bottle; providing such an unloader system which provides for rotating a valve guard in increments corresponding to fractions of the compressor crankshaft rotation; providing such an unloader system which is economical to manufacture, efficient in operation, capable of a long operating life and particularly well-adapted for the proposed usage thereof; providing a compressor unloading method; providing such an unloading method which is synchronized with the compressor crankshaft; providing an unloading method which facilitates efficient compressor operation; providing such an unloading method which is adaptable for use with various types of valve assemblies and providing such an unloading method which is efficient, economical and adaptable for use with various compressors.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
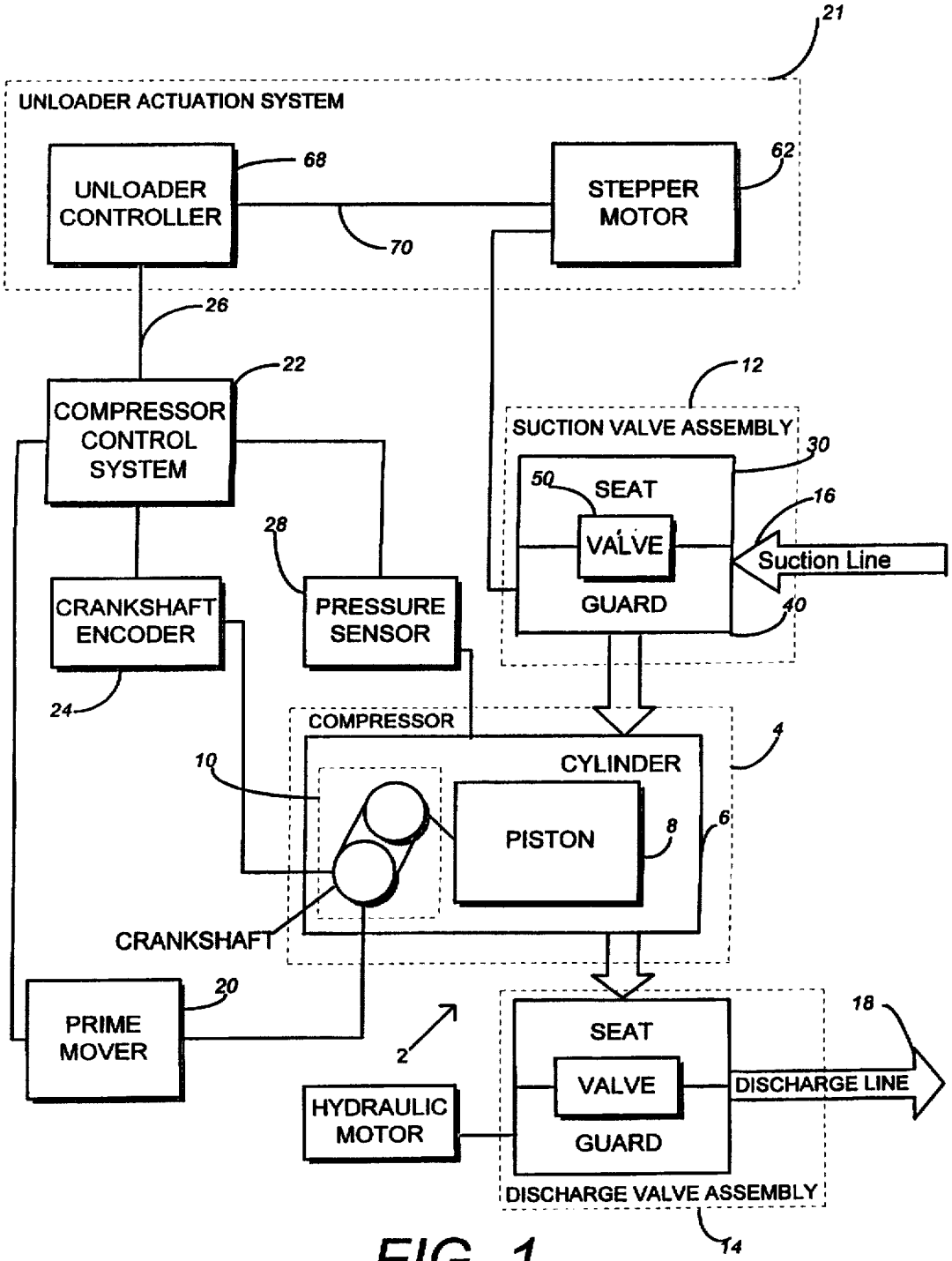
FIG. 1 is a schematic view of an unloader system embodying the present invention, shown in combination with a reciprocating compressor and a prime mover.
Figure 2:
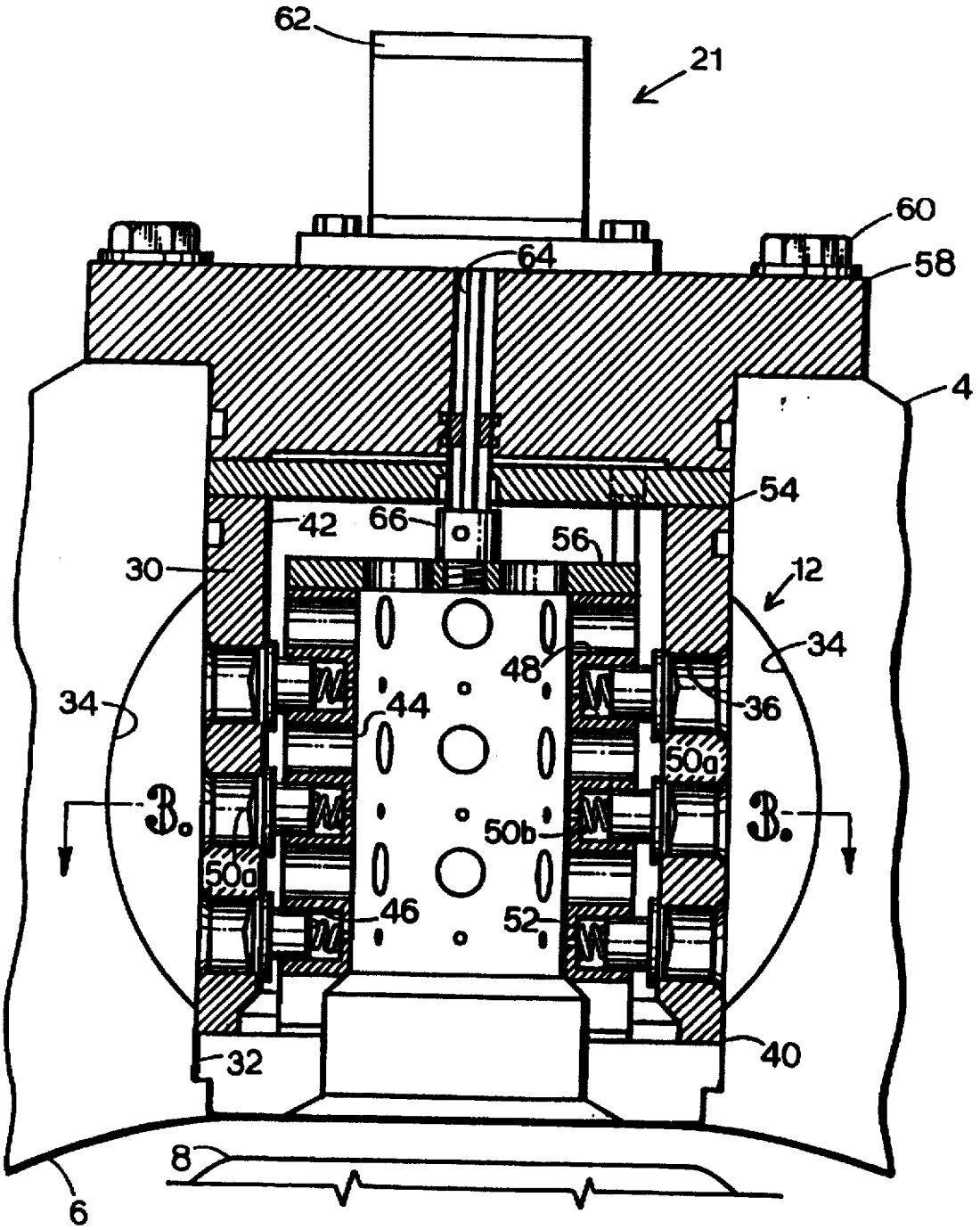
FIG. 2 is a fragmentary, vertical, cross-sectional view of a radial suction valve assembly thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates an unloader system embodying the present invention. The unloader system 2 is adapted for use in connection with a reciprocating compressor 4 including a cylinder 6 reciprocably receiving a piston 8 connected to a crankshaft 10. Suction and discharge valve assemblies 12, 14 selectively communicate suction and discharge lines 16, 18 respectively with the cylinder 6.

The unloader system 2 of the present invention is suitable for use with a wide variety of reciprocating compressors, which can include multiple cylinders, each of which can have multiple suction and discharge valve assemblies 12, 14. The compressor 4 is driven by a suitable prime mover 20, which can comprise an internal combustion engine or a motor drivingly connected to the crankshaft 10. The compressor 4 has a control system 22 associated therewith which can include, for example, a computerized ignition system controlling ignition, air/fuel mixtures, rotational speed, compressor discharge pressure and other parameters associated with the operation of the prime mover 20 and the compressor 4. A feature of the control system 22, which is common to many large-scale compressors, is an encoder 24 providing a signal corresponding to the orientation of the crankshaft 10 throughout a revolution thereof. The rotational orientation of the crankshaft 10 is typically given with reference to top dead center ("TDC"), whereby bottom dead ("BDC") is located 180° therefrom. The encoder 24, in conjunction with the control system 22, can provide appropriate electrical signals corresponding to the orientation of the crankshaft 10 on, for example, an engine control system output bus 26. A signal corresponding to pressure within the cylinder 6 can be generated and output by means of a pressure sensor 28.

II. Suction Valve Assembly 12

The suction valve assembly 12 functions as the unloader valve assembly in this embodiment and generally has a radial configuration similar to the radial valve assembly disclosed in the Sperry U.S. Pat. No. 5,331,998 for Radial Valve with Unloader Assembly for Gas Compressor, which is incorporated herein by reference. The suction valve assembly 12 includes a generally cylindrical valve seat 30 received in a valve pocket 32 in communication with a suction chamber 34, which communicates with the suction line 16. The valve seat 30 includes a plurality of seat passages 36 arrayed in a seat passage circle and extending therethrough with beveled, concentric seat contacts 38 at their inner ends.

A generally cylindrical valve guard 40 is located within a valve seat bore 42 formed concentrically within the valve seat 30. The guard 40 includes a guard bore 44 extending concentrically therethrough and includes a plurality of outwardly-open, radially-extending poppet receivers 46 and a plurality of guard passages 48 located generally between the receivers 46.

A plurality of valve members comprising poppets 50 are reciprocably mounted on the guard 40 in a valve circle and each has a poppet head 50*a* selectively, sealingly engageable with a respective seat contact 38 and a poppet stem 50*b* reciprocably mounted within a respective poppet receiver 46. Helical poppet return springs 52 are positioned in the poppet receivers 46 in engagement with the poppet stems 50*b* for biasing same towards their respective closed positions.

A seat cover 54 and a guard cover 56 are respectively mounted on the seat 30 and the guard 40 on the outboard ends thereof. A valve assembly cap 58 is provided for mounting the valve assembly 12 in the valve pocket 32 by means of suitable cap mounting bolts 60.

The configuration of the valve assembly 12 includes multiple tiers (e.g., three are shown) of eight valve members 50 in each tier for a total of 24 poppets. However, other numbers, spacings and configurations of valve members could be used in valve assemblies within the scope of the present invention. The eight valve members 50 of each valve tier are oriented radially with respect to each other at 45° intervals (360°/8=45°).

III. Unloader Actuation System 21

An unloader actuation system 21 includes a stepper motor 62 concentrically mounted on the valve assembly cap 58. Without limitation on the generality of useful stepper motors, a stepper motor or indexer/drive is available under the trademark "COMPUMOTOR" from the Parker Hannifin Corporation, Compumotor Division, 5500 Business Park Drive, Rohnert Park, Calif. 94928. The stepper motor 62 is adapted to rotate in incremental cycles corresponding to the radial spacing of the poppet valves 50, e.g. 45° for the illustrated embodiment and described by the formula: S=360°/N where S is the angular spacing between valves and N is the number of valves in the circle.

Alternatively, other types of motors could be utilized, including hydraulic and pneumatic motors. Still further, a direct drive arrangement could be implemented between the compressor crankshaft 10 and the valve guard 40, with a suitable drive ratio and suitable engagement/disengagement means such as a clutch (not shown). The stepper motor 62 has a drive shaft 64 which is concentrically connected to the guard cover 56 by a suitable coupling 66, such as a keyed or splined coupling.

The unloader actuation system 21 also includes an unloader controller 68 which is connected to the control system 22. The controller 68 can be implemented with hardware, software or a combination of both, and can be programmed in the control system 22. The controller 68 is adapted for providing suitable signals to the stepper motor 62, which can comprise, for example, square wave signals of various timing and duration, or other appropriate signals as required for particular operating conditions. The unloader controller system 68 is connected to the stepper motor 62 by a suitable stepper motor electrical lead 70.

IV. Unloading Method

In the unloading method of the present invention, the unloader system 2 functions to unload the compressor 4 through essentially a continuous range which can be adjusted in essentially unlimited increments. Such unloaders of this class are generally referred to an "infinite step" unloaders, as opposed to unloaders with predetermined ranges of unloaded conditions. The operating parameters of the compressor 4 can be controlled by the unloader system 2 in response to various external conditions, such as pressure within the gas lines 16, 18; demand conditions; fuel economy optimization for the prime mover 20, etc.

Figure 5:
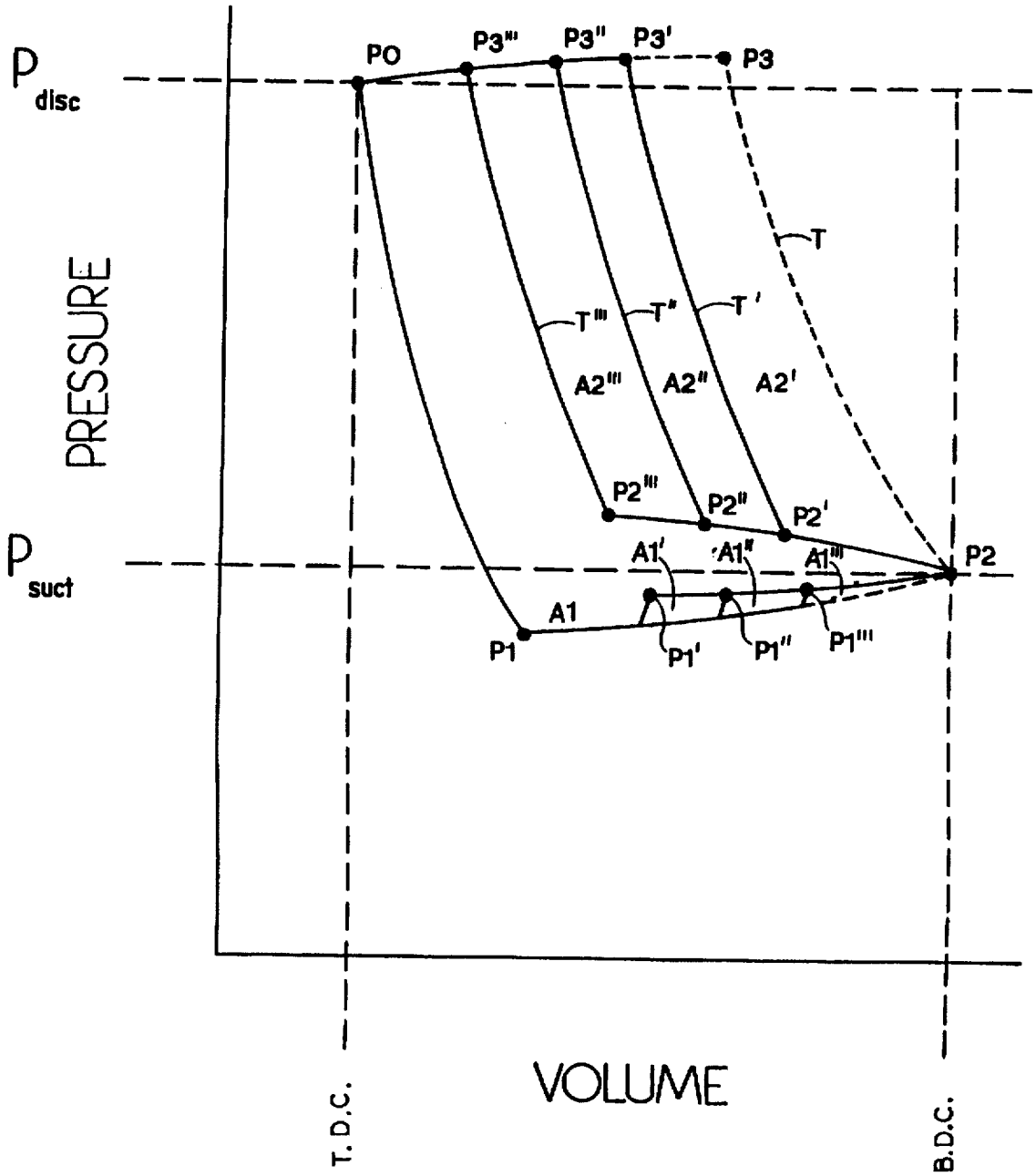
FIG. 5 is a pressure-volume (PV) graph showing a PV trace for the compressor in operation with various stages of unloading.

The operation of the compressor 4 and the unloader system 2 is represented by a pressure/volume graph, commonly referred to as a "PV" trace 72 (FIG. 5). Normal, fully-loaded operation of the compressor 4 is shown in dashed lines by trace T and various unloaded conditions are shown in solid lines by traces T', T" and T"' where unloaded operating conditions vary from normal, fully-loaded operating conditions.

The PV trace 72 illustrates one complete cycle of the compressor piston 8, which corresponds to a complete 360° revolution of the crankshaft 10. P0 (origin) at TDC occurs as the discharge valves close and reexpansion line P0–P1 commences. P1 represents opening the suction valves and commences a suction stroke represented by line P1–P2. Compression within the cylinder 6 occurs along line P2–P3, with the suction valves closing at P2 and the discharge valves opening at P3. P2 occurs at bottom dead center ("BDC", 180° of crankshaft 10 revolution from TDC). Discharge occurs along line P3–P0 whereat the discharge valves are open.

The trace 72 bounds an area which corresponds to the mount of work done by the compressor 4 in a single cycle. Thus, unloading the compressor 4 generally corresponds to reducing the area bounded by the trace 72.

The present invention operates primarily by controlling the points at which the valves close, i.e., P2 for the suction valves and P0 for the discharge valves. On the suction side of the compressor 4, the unloader system 2 operates by delaying the closing of the suction valve poppets 50 to the points P2', P2" and P2"', which result in modified traces represented by T', T" and T"' respectively.

Figure 3:
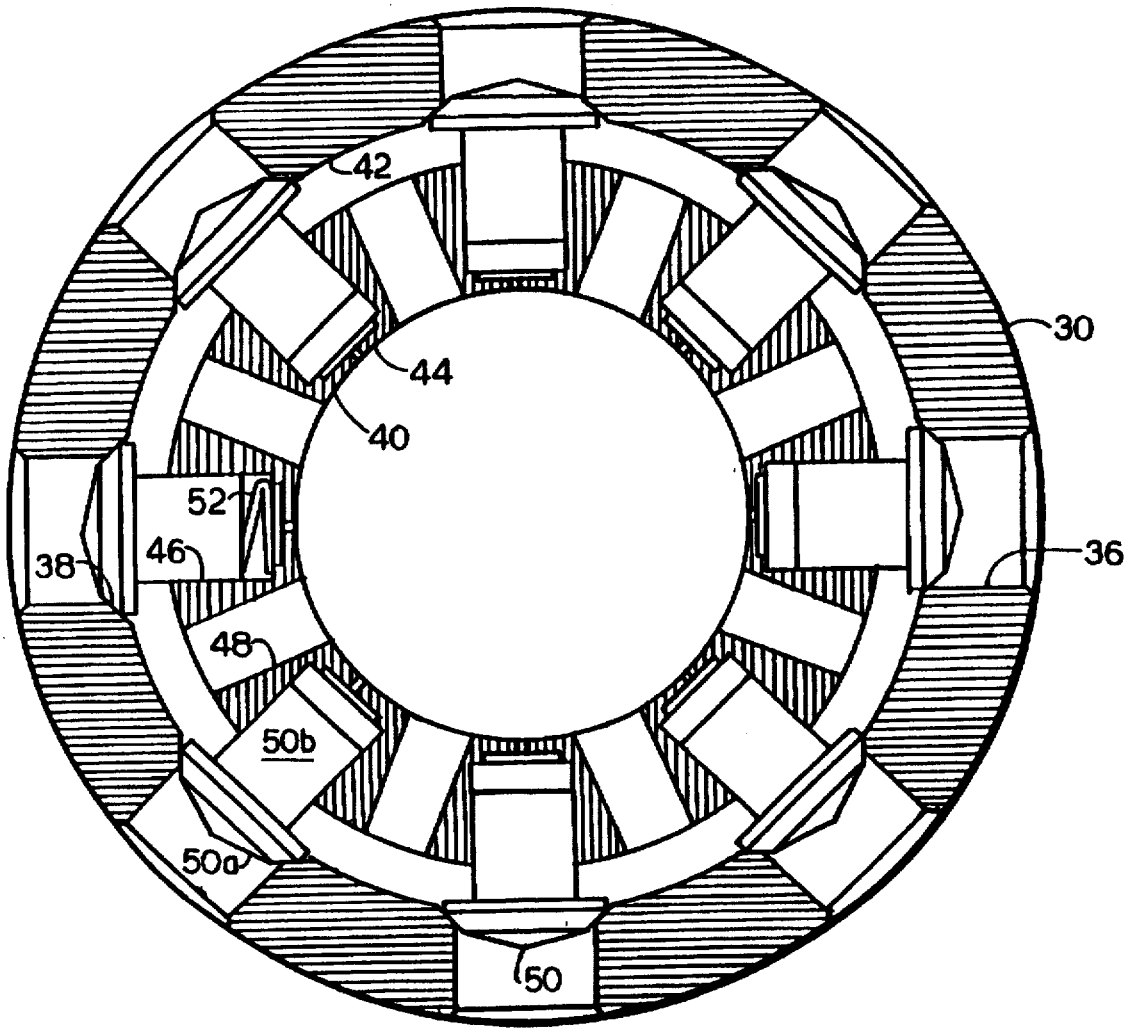
FIG. 3 is an enlarged, fragmentary, horizontal, cross-sectional view of the radial suction valve assembly, taken generally along line 3—3 in FIG. 2 and showing the value members and the valve guard in their respective loaded positions.

Upon receipt of an appropriate signal from the unloader controller 68, the stepper motor 62 commences a rotation of the guard 40 with the poppet valve members 50 generally aligned with respective seat passages 36 in a loaded position (FIG. 3) to an unloaded position (FIG. 4) with the poppet valve members 50 located approximately midway between respective adjacent pairs of seat passages 36. Each complete cycle of the unloader system 2 represents a rotation of the guard 40 through approximately 45° (360°/N=360°/8=45° for the illustrated embodiment with eight valves arrayed in a circle). The unloader system 2 cycles once for each complete revolution of the crankshaft 10, and thus rotates at ⅛th the rotational speed of the crankshaft 10 for the illustrated embodiment. Each cycle of the unloader system 2 can be accomplished in two steps, a first step of approximately 22½° from a loaded position (FIG. 3) to an unloaded position (FIG. 4) and a second stage of about 22½° from the unloaded position (FIG. 4) to a loaded position (FIG. 3). The valve guard 40 preferably rotates continuously in the same direction.

Trace areas A2', A2" and A2"' corresponds to the work performed by the copmressor per cycle which is saved by delaying the closings of the valves to points P2', P2" and P2"' respectively. Although specific exemplary suction valve closure points P2 are shown, suction valve closure could occur at essentially any point with the unloader system 2 of the present invention.

Figure 4:
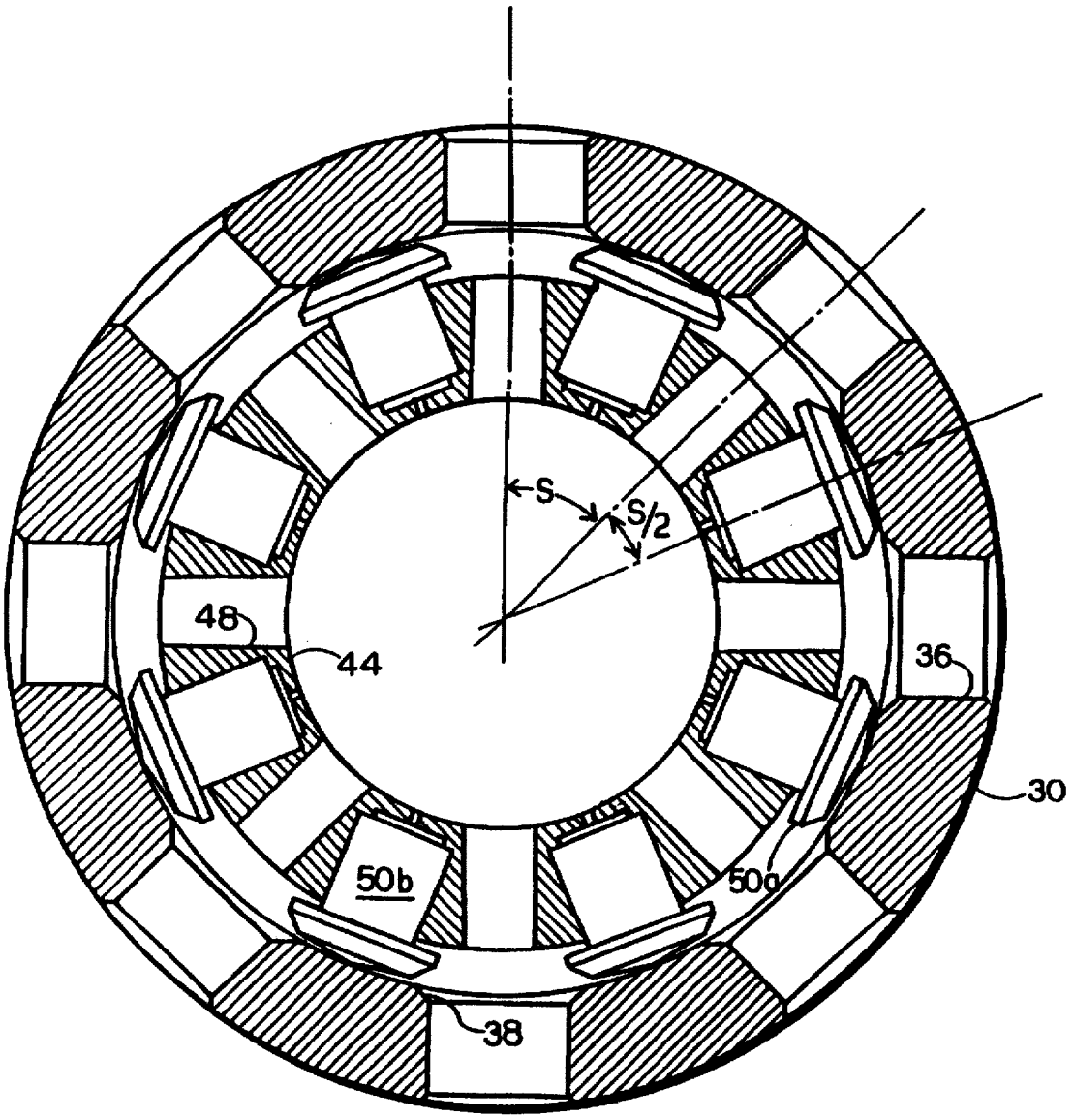
FIG. 4 is an enlarged, horizontal, cross-sectional view of the radial suction valve assembly, showing the valve members and the valve guard rotated to their Unloaded positions.

Point P1 corresponds to the point at which the suction valves open. P1 is located below the suction pressure line Psuct (Fig. 5) because the pressure must drop below the predefined suction pressure in order to open the valves. The area designated A1 represents work expended by the compressor in opening the suction valves and in overcoming the flow resistance caused by the valve poppets 50 being located in the path of the gas flow and resisting same. The work expended in A1 can be reduced by the unloader system 2 since it rotates the poppets 50 to positions located essentially midway between the seat passages 36, thus removing them from positions where they could interfere with and impede gas flow. The points P1', P1", and P1"' correspond to the actuation of the stepper motor 62 with rotation to the unloaded, midway position (FIG. 4). Preferably the controller 68 initiates the incremental rotation to unload the compressor 4 at such points P1', P1" and P1"' which correspond to the suction valve closure points P2', P2" and P2"' by 180° of crankshaft 10 revolution. The areas A1', A1" and A1"' represent energy saved by rotating the guard 40 to the unloaded positions whereby the poppets 50 are removed from the path of gas flow from the seat passages 60, thus reducing gas flow resistance through the suction valve assembly 12.

Thus, the controller 68 can be adjusted to allow the suction valves 50 to close at predetermined orientations of the crankshaft 10 past BDC, with the actuation of the stepper motor 62 automatically corresponding to positions which occur at 180° of crankshaft 10 revolution prior to such suction valve poppet 50 closings.

Closing of the suction valve poppet 50 is accomplished by rotating the guard 40 to a position in alignment with the next set of seat passages 36, i.e., corresponding to the completion of a 45° rotational shift of the guard 40. The suction valve poppets 50 would normally be in aligned, loaded positions with respective seat passages 36 for half-cycles corresponding to 180° of crankshaft 10 revolution.

In an unloaded condition the poppet valve members 50 would remain open for periods corresponding to more than 180° of crankshaft 10 revolution, e.g., corresponding to the rotation of the crankshaft which occurs between point P1 and any of points P2', P2" and P2"' (FIG. 5). Thus, the unloader system 2 effectively delays the closing, but not the opening, of the suction valves poppets 50.

Advantageously, the guard 40 is not rotated until after the poppets 50 open to reduce the amount of torque force required to rotate the guard 40. With poppets 50 in their open positions, the guard 40 can be rotated with relatively little torque force and the rotation can be completed at various points after P2. After point P2 the piston 8 has commenced a compression stroke whereby, in an unloaded condition, gas within the cylinder 6 is pumped back into the suction chamber 34. Upon completing the incremental rotation of the guard 40 (i.e., at points P2', P2" or P2"'), the gas flow back into the suction header keeps the poppets in contact with the seat thus avoiding a hammering or slamming condition which is a significant source of wear for poppets in conventional systems.

Rotation of the valve guard 40 is facilitated by the pressurized gas acting on the poppets 50 in their open positions as the guard 40 rotates them toward their midway positions. The gas flow along their edges thus imparts an additional torque force facilitating the rotation and lessening the load on the stepper motor 62.

V. First Modified Embodiment Unloader System 101 With Single Deck Discharge Valve Assembly 102

Figure 6:
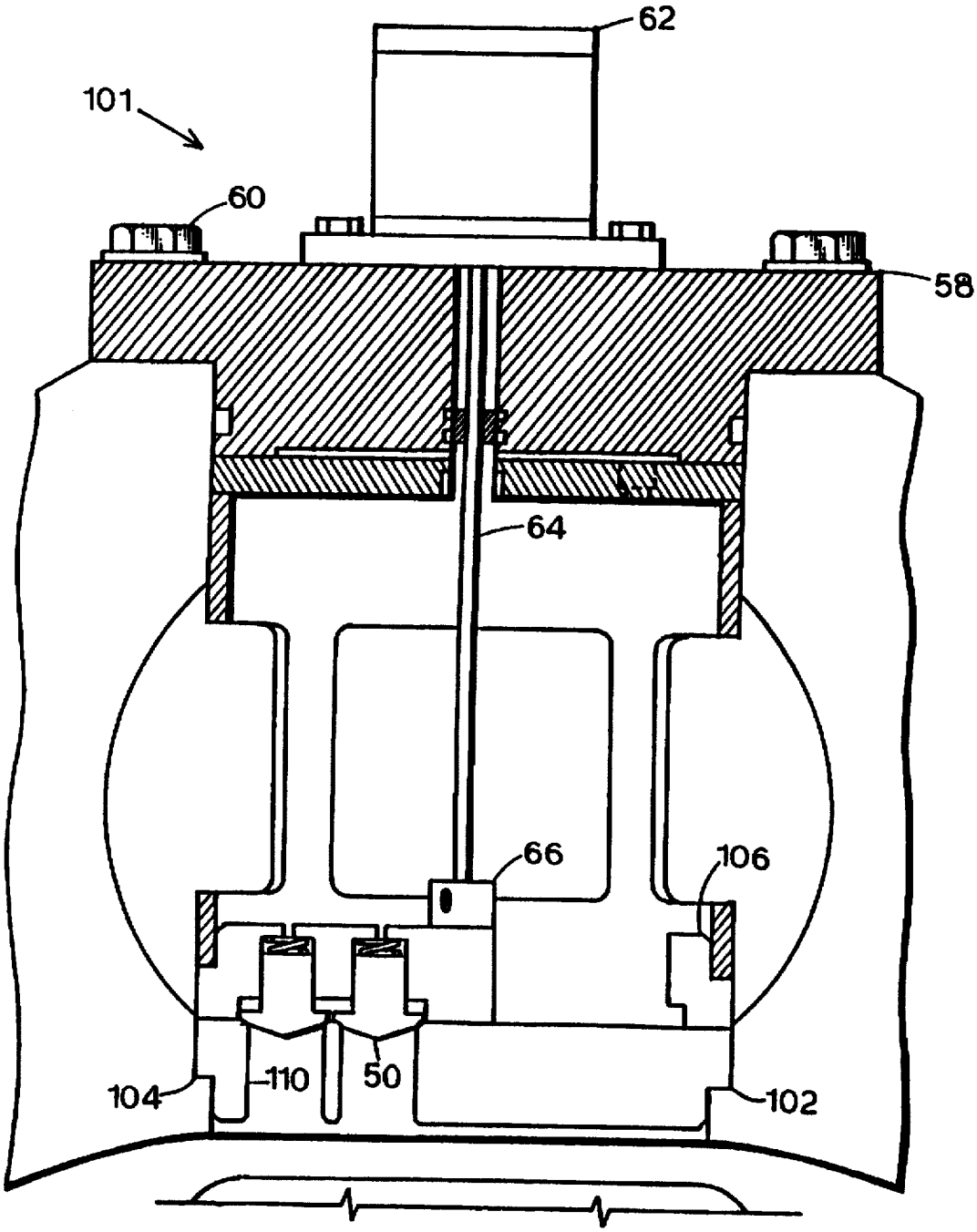
FIG. 6 is an enlarged, vertical, cross-sectional view of a single deck discharge valve assembly for a first modified or alternative embodiment of the present invention.

An unloader system comprising a first modified or alternative embodiment of the present invention is shown in FIG. 6 and is generally designated by the reference numeral 101. The unloader system 101 includes as the unloader valve assembly a single deck discharge valve assembly 102 located in the valve pocket 32. The single deck discharge valve assembly 102 includes a fixed-position valve seat 104 and a rotatable valve guard 106 coupled to a stepper motor 62 and incrementally rotatable, as in the case of the radial valve assembly guard 40.

The poppets 50 are arrayed in evenly-spaced locations along concentric inner and outer poppet rings 108*a*, 108*b*, with appropriate spacing between each pair of poppets 50. Thus, eight poppets per ring would provide spacings of 45° each as with the unloader assembly 2.

An advantage of utilizing a discharge valve assembly for the unloader system 101 is that the guard 106 is located on the exterior of the compressor 4 for greater accessibility than would be the case with a single deck suction valve assembly which has its valve guard positioned interiorally adjacent the compressor cylinder 6. However, a suction single deck valve could also be used as the unloader valve assembly.

Figure 7:
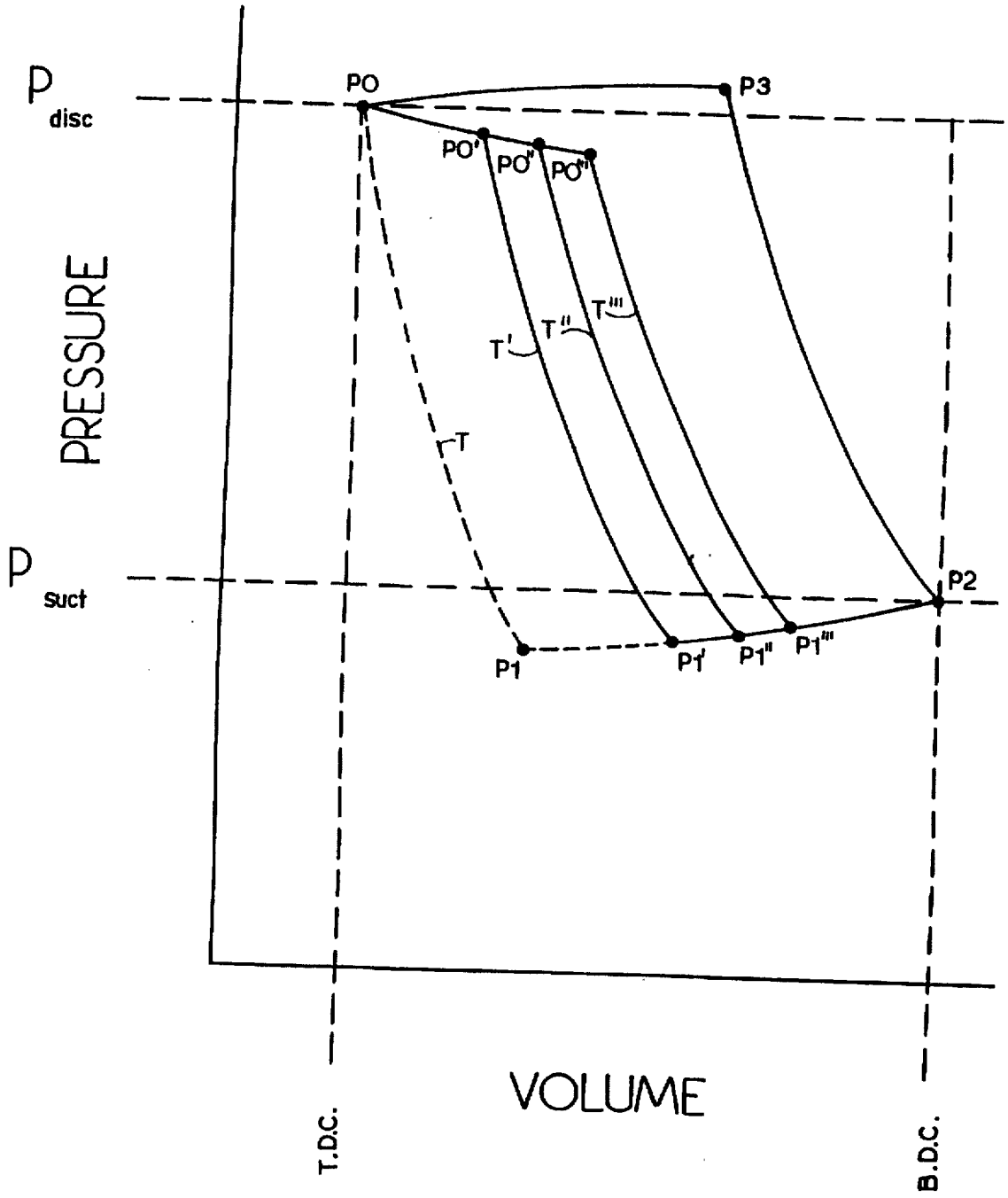
FIG. 7 is a PV graph showing traces of compressor operation with several stages of unloading with the unloader system comprising the first modified embodiment of the present invention with the single deck discharge valve.

A PV trace for various degrees of unloading by means of the unloader system 101 is shown in FIG. 7 and includes alternative points PO', PO", PO"' and corresponding points P1', P1", P1"', which corresponding point pairs are connected by modified trace outlines T', T", T"'.

The operation of the single deck discharge valve unloader system 101 is primarily a function of delaying the closing of the discharge valve 102 by delaying the closing of its poppets 50 in a manner similar to that described in connection with the unloader system 2. For a predetermined period after TDC the compressor 4 pumps gas into the discharge line 18. The inner and outer poppet rings 108*a*, 108*b* can be provided with the same number of valves in each whereby the spacing between the valves in each ring will be equal.

The unloader system 101 can provide incremental rotational shifting corresponding to the lesser number of poppets (typically in the inner poppet ring 108*a*) and, if necessary, skip over seat passages 110 in the outer ring 108*b*. It is generally not necessary to delay the closing of all of the poppets in a given valve assembly in order to achieve unloading. Although gas flow characteristics are improved by retaining all poppets in an open position, unloading can be achieved with less than the total number of poppets in a given valve assembly.

VI. Second Modified Embodiment Unloader System 201 With Double Deck Suction Valve Assembly 202

Figure 8:
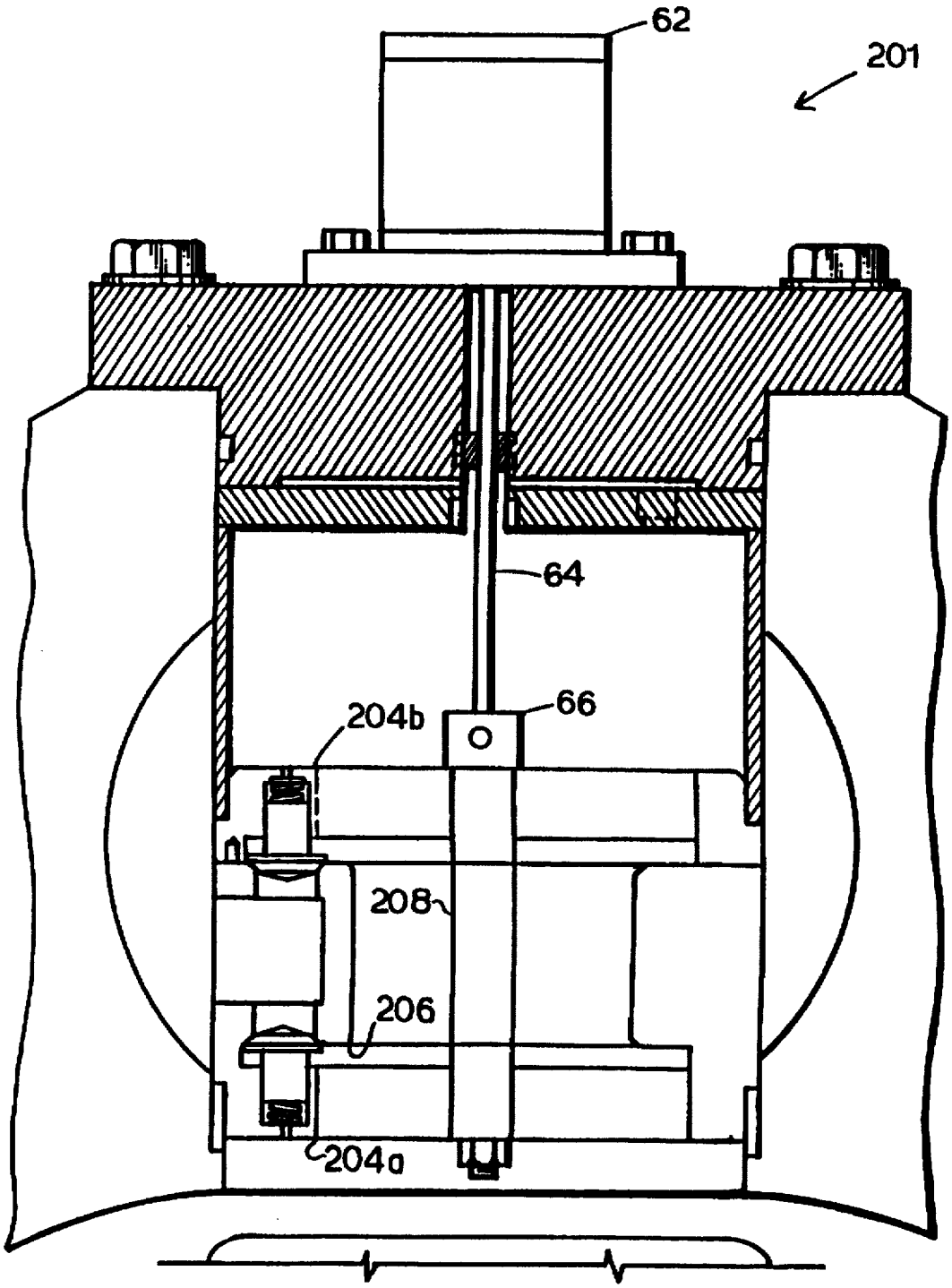
FIG. 8 is a vertical, cross-sectional view of a double deck suction valve assembly for an unloader system comprising a second modified or alternative embodiment of the present invention.

An unloader system 201 comprising a second modified or alternative embodiment of the present invention is shown in FIG. 8 and is adapted for use with a double-deck suction valve assembly 202 functioning as the unloader valve assembly. The double-deck suction valve includes inboard and outboard guards 204*a*, 204*b* with a two-sided valve seat 206 therebetween. A stepper motor connector 208 connects a stepper motor 62 to the guards 204*a*, 204*b* for unloading operation as with the previously described embodiments.

The second alternative embodiment unloader assembly 201 could be utilized in connection with either a suction or a discharge valve, but with equal accessibility to either kind it is generally preferred to unload by means of a suction valve assembly. Unloading a suction valve assembly in this manner, i.e., by delaying the closing of the suction valve members, causes gas to be pumped back into the suction chamber 34, which is generally at a lower pressure than the discharge chamber and thus requires less work by a prime mover 20.

VII. Third Modified Embodiment Unloader System 301 with Clearance Bottle 306

Figure 9:
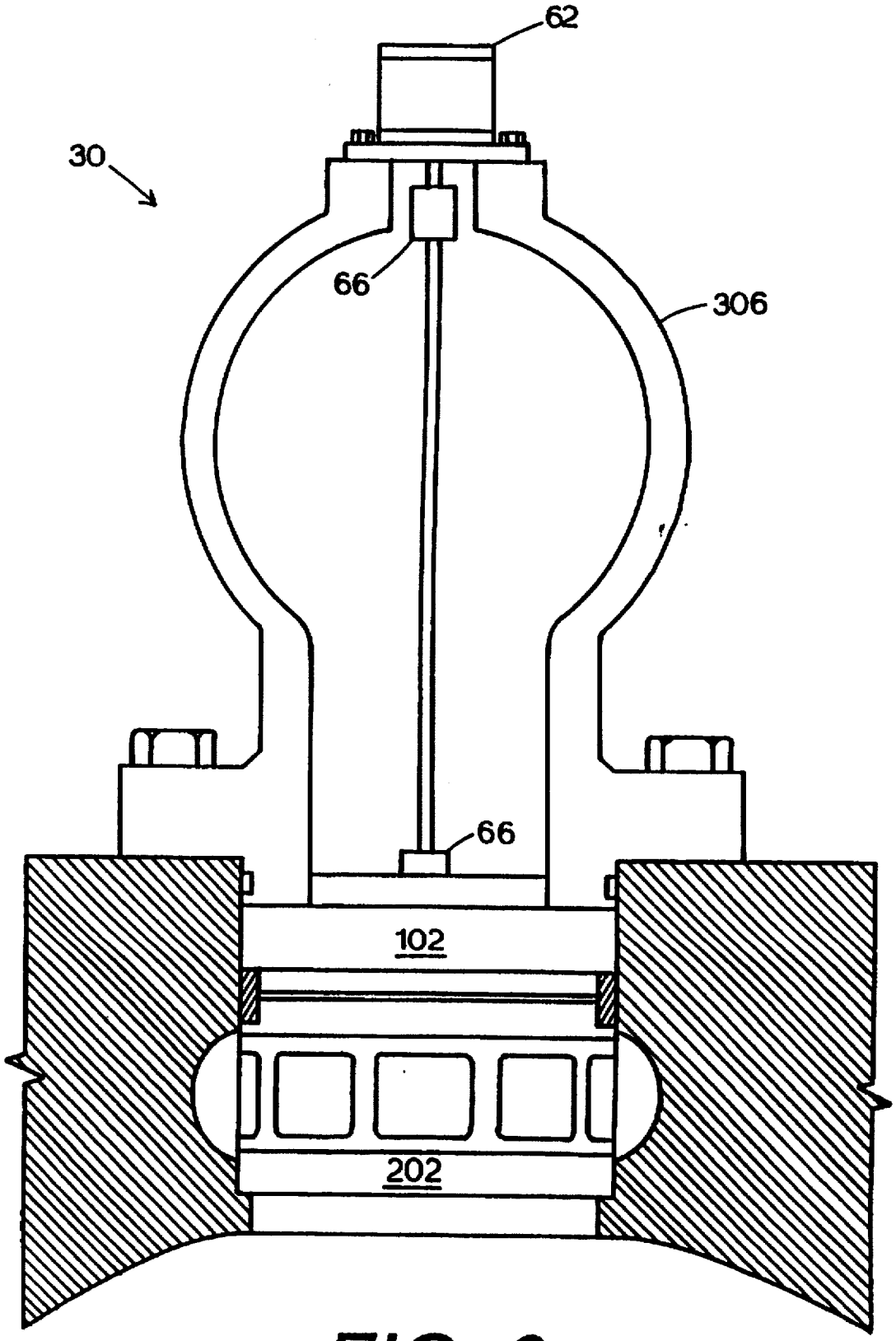
FIG. 9 is a vertical, cross-sectional view of an unloader system comprising a third modified or alternative embodiment of the present invention, with a clearance bottle selectively communicating with a suction valve pocket by means of a single deck valve.

A third modified or alternative embodiment of the present invention is shown in FIG. 9 and includes a double deck suction valve assembly 202 similar to that shown in connection with the second alternative embodiment unloader system 201 in the valve pocket 32. A clearance bottle 306 is mounted outboard the double deck suction valve assembly 202 in selective communication with the valve pocket 32. With the clearance bottle 306 in communication with the compressor cylinder 6, additional clearance is added to the compressor 4 which has the effect of unloading same.

A single deck valve assembly 102, similar to that shown in connection with the first modified embodiment unloader system 101, functions as the unloader valve assembly and controls communication between the compressor cylinder 6 and the clearance bottle 306.

In operation, the controller 68 functions to control synchronized rotation of the valve guard 6 whereby fluidic communication between the compressor cylinder 6 and the clearance bottle 306 is controlled.

As with the previously described unloader systems, the unloader system 301 synchronizes rotation of the valve guard 106 with the unloading of the compressor 4 being essentially infinitely adjustable thereby. The single deck valve assembly 102 can be maintained in its open position by rotating the guard 106 thereof half a cycle (i.e., 22.5°) with respect to the seat 104 and retaining it in such a position whereby the clearance bottle 306 is continuously in communication with the compressor cylinder 6.

Operation of the third modified embodiment unloader system 301 with a clearance bottle 306 can be accomplished in alternative manners with essentially infinite control (within operating parameters) in connection with each.

Figure 10:
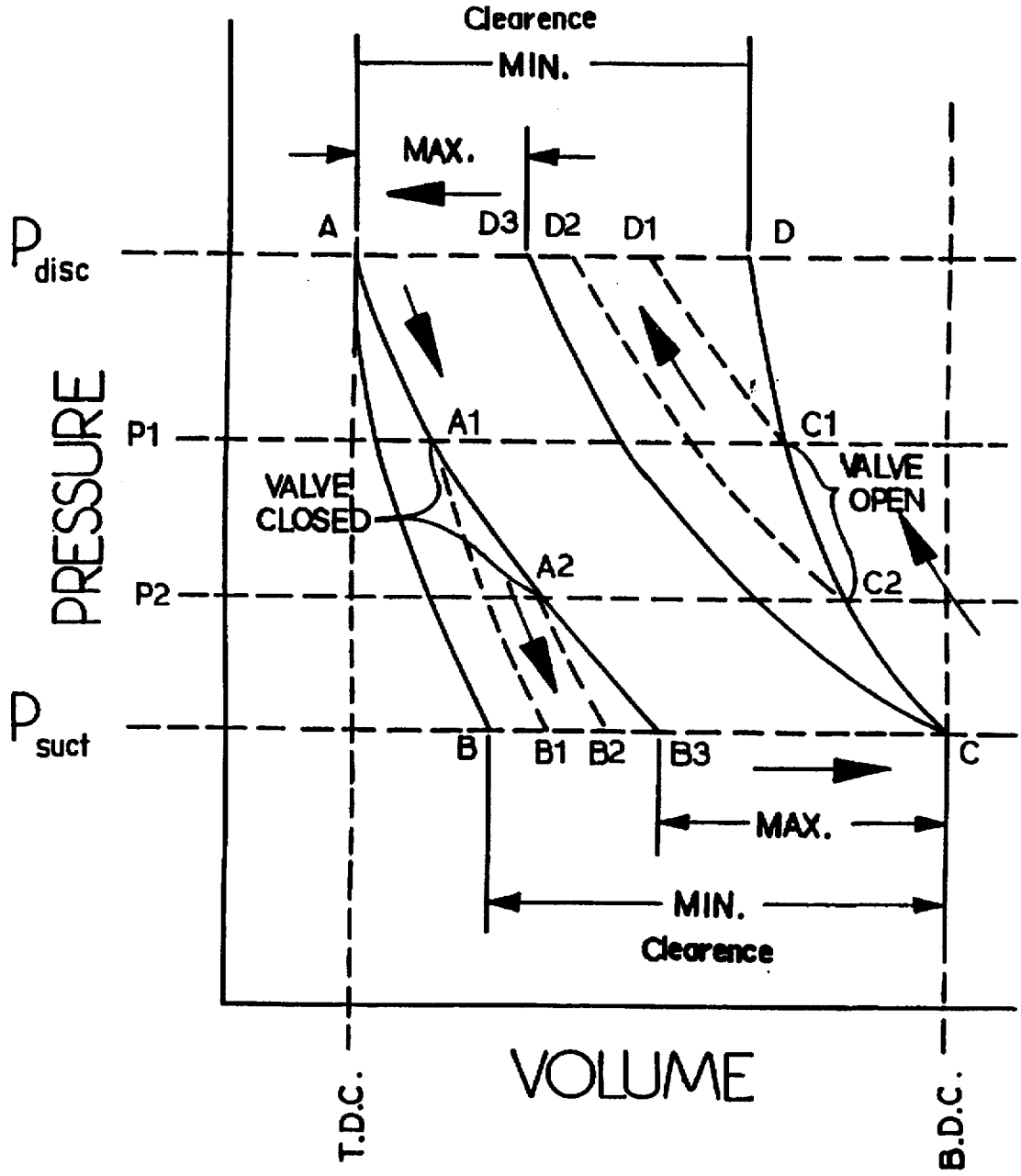
FIG. 10 is a PV graph showing traces corresponding to operation of the unloader system including the clearance bottle.

FIG. 10 shows a PV trace depicting pressure and volume conditions with various sequences of clearance bottle 306 communication with the cylinder 6. For example, trace ABCD represents a fully-loaded minimum clearance operating condition with the clearance bottle 306 closed off from the cylinder 6. PV trace A-B3-C-D3 depicts an unloaded maximum clearance condition with the clearance bottle 306 in continuous communication with the compressor cylinder 6.

Intermediate PV traces are shown which could be implemented by the unloader system 301. Trace A-A1-B1-C-C1-D1-A represents the single deck clearance bottle valve assembly 102 being opened at C1 and closed at A1. The controller 68 can accomplish opening and closing of the valve assembly 102 at these points by means of a pressure sensor. Both opening and closing could occur at approximately the same accomplish opening and closing of the valve assembly 102 at these points by means of a pressure sensor. Both opening and closing could occur at approximately the same pressure as depicted by the locations on the same pressure line P1 in FIG. 10. The trace A-A2-B2-C-C2-D2-A represents opening and closing the clearance bottle valve 306 at a lower pressure P2, corresponding to a greater flow reduction through the compressor 4.

Figure 11:
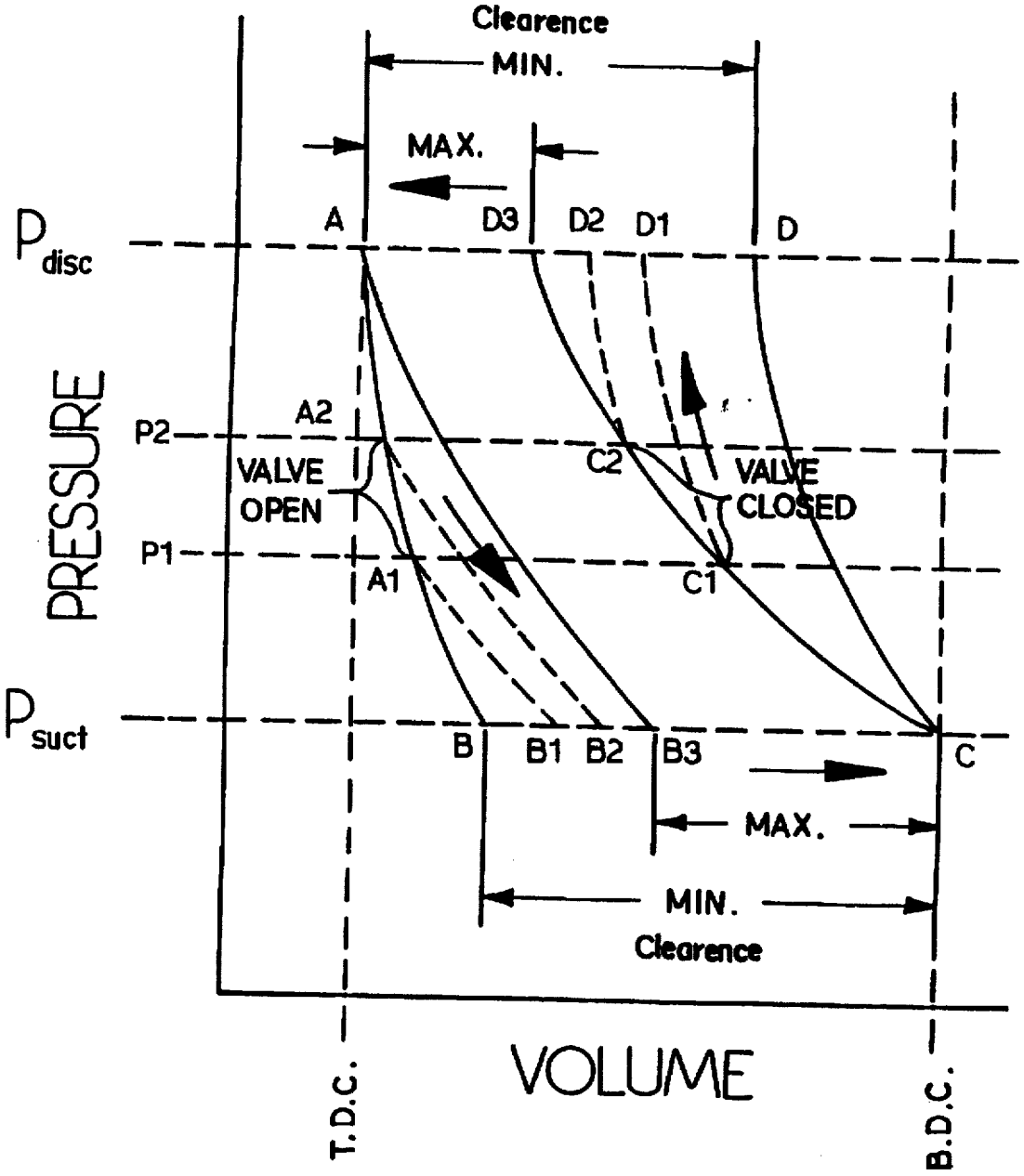
FIG. 11 is a PV graph showing operation of the unloader system with the compressor bottle, with valve openings and closings occurring at locations along the PC traces opposite to those shown in FIG. 10.

FIG. 11 shows an alternative procedure for achieving variable unloading in connection with the clearance bottle 306 wherein the clearance bottle valve 102 is open for the lower portion of the trace, i.e., opening at point A1 or A2 and closing at C1 or C2 respectively. The valve seat 104 is adjacent to the clearance bottle 306 and the valve guard 106 is adjacent to the valve pocket 32. Thus, trace A-A1-B1-B1-C-C1-D1-A defines a first partially unloaded condition utilizing the unloader system 301, and trace A-A2-B2-C-C2-B2-A defines a second partially unloaded condition. As with the previously described condition, the actuation of the stepper motor 62 can be synchronized with the compressor 4 by means of appropriate pressure sensors 28. Flow reduction achieved by the unloader system 301 is graphically represented in FIGS. 10 and 11 and corresponds to the distance between point C (BDC) and one of points B, B1, B2 or B3 whereat the suction valve assembly 102 opens, with distance B-C representing fully loaded operation with minimum clearance, distance B3-C representing partially unloaded operation with maximum clearance, and intermediate partially unloaded operating conditions being represented by distance B1-C and B2-C. As with the previously described embodiments, the differences in areas represented by the traces for various conditions of unloading correspond to the work saved.

It is to be understood that while certain forms of the present invention have been illustrated and described herein, it is not to be limited to the specific forms or arrangement of parts described and shown.

What is claimed and desired to be secured by Letters Patent is as follows:

1. An unloader system for a reciprocating compressor including a cylinder, a piston reciprocably mounted in the cylinder, a rotatable crankshaft connected to the piston, a suction line, a discharge line, a suction valve assembly and a discharge valve assembly for selectively communicating the suction and discharge lines respectively with the compressor cylinder, which unloader system comprises:

(a) an unloader valve assembly having a valve seat with multiple seat passages arrayed in a seat passage circle, a valve guard and a plurality of valve members movably mounted on the valve guard between open and closed positions with respect to said seat passages, said valve members being arrayed in a valve circle, said valve guard being rotatably mounted on said valve seat about a rotational axis concentric with said seat passage circle and said valve circle;

(b) said valve members having a predetermined radial spacing with respect to the rotational axis of said valve guard;

(c) valve guard rotating means for rotating said valve guard in increments corresponding to said valve member circumferential spacing between loaded positions aligned with respective valve seat passages and unloaded positions misaligned therewith; and (d) compressor/unloader synchronization means for synchronizing the incremental rotation of said valve guard with said compressor crankshaft.

2. The unloader system according to claim 1, which includes:

(a) said valve guard having a generally cylindrical configuration with a guard bore communicating with the compressor cylinder; and (b) said valve assembly comprising a radial valve assembly with a generally cylindrical valve seat having a seat bore rotatably receiving said valve guard.

3. The unloader system according to claim 2, which includes:

(a) a plurality of radially-spaced seat passages in said valve seat; and (b) a plurality of radially-spaced poppets reciprocably mounted on said valve guard.

4. The unloader system according to claim 1, which includes:

(a) said rotating means comprising a stepper motor mounted on said compressor cylinder outboard said valve assembly.

5. The unloader system according to claim 4 wherein:

(a) said compressor unloader synchronization means includes means for synchronizing the rotation of said stepper motor with the rotation of said compressor crankshaft whereby the stepper motor rotates the valve guard through an incremental rotational amount equal to 360°/N, wherein N represents the number of valve members in the valve circle, for each crankshaft revolution.

6. The unloader system according to claim 5, which includes:

(a) said controller having means for incrementally rotating said stepper motor and said valve guard to said valve member unloaded positions located approximately midway between said loaded position.

7. The unloader system according to claim 6, which includes:

(a) said synchronization means including means for initiating said seat guard rotation and terminating said seat guard rotation during a cycle corresponding to a revolution of said compressor crank shank through approximately 180°.

8. The unloader assembly according to claim 7 wherein said synchronization means includes:

(a) means for cycling said unloader system in a first step shifting said valve members from their loaded positions in alignment with respective seat passages to unloaded positions approximately midway between respective adjacent pairs of seat passages and a second step from said unloaded positions to loaded positions in alignment with adjacent respective seat passages.

9. The unloader system according to claim 1, which includes:

(a) means for varying the timing of the closing of said valve members with respect to the angular orientation of said compressor crankshaft.

10. The unloader system according to claim 1 wherein:

(a) said synchronization means includes means for delaying said suction valve member closings into the normal compression stroke of said compressor.

11. The unloader system according to claim 1 wherein said unloader valve assembly comprises a single deck valve assembly.

12. The unloader system according to claim 1 wherein said unloader valve assembly comprises a double deck valve assembly.

13. The unloader system according to claim 1, which includes:

(a) a compressor clearance bottle mounted in selective communication with said compressor cylinder for increasing a clearance volume of said compressor cylinder whereby the extent of compressor unloading increases; and (b) said unloader valve assembly comprising a single deck valve assembly mounted between said compressor cylinder and said clearance bottle for controlling communication therebetween.

14. The unloader system according to claim 13, which includes:

(a) said rotating means comprising a stepper motor mounted on an outboard end of said compressor bottle; and (b) a shaft connecting stepper motor and said valve guard.

15. The unloader system according to claim 1, wherein:

(a) said rotating means comprises a hydraulic motor.

16. The unloader system according to claim 1 wherein said unloader valve assembly comprises the suction valve assembly.

17. The unloader system according to claim 1 wherein said unloader valve assembly comprises the discharge valve assembly.

18. An unloader system for a reciprocating compressor including a cylinder, a piston reciprocably mounted in the cylinder, a rotatable crankshaft connected to the piston, a suction line, a discharge line, a suction valve assembly and a discharge valve assembly for selectively communicating the suction and discharge lines respectively with the compressor cylinder, which unloader system comprises:

(a) an unloader valve assembly having a valve seat with multiple seat passages arrayed in a seat passage circle, a valve guard and a plurality of valve members movably mounted on the valve guard between open and closed positions with respect to said seat passages, said valve members being arrayed in a valve circle, said valve cage being rotatably mounted on said valve seat about a rotational axis concentric with said seat passage circle and said valve circle;

(b) a stepper motor mounted on said valve cap coaxially with respect to said valve seat;

(c) a coupling drivingly connecting said stepper motor to said valve guard; and (d) a controller including means for incrementing said stepper motor in successive cycles corresponding to the angular spacing of said valves in synchronization with said compressor crankshaft, each said incremental rotation of said stepper motor corresponding to a complete revolution of said crankshaft and consisting of a first rotation from a loaded position with each said valve member aligned with a respective seat passage to an unloaded position with each said valve member being located between a respective pair of adjacent seat passages, and a second rotational movement from said unloaded positions to loaded positions aligned with respective, adjacent seat passages.

19. A method of unloading a reciprocating compressor including a cylinder, a piston reciprocably mounted in the cylinder, a rotatable crankshaft connected to the piston, a suction line, a discharge line, a suction valve assembly and a discharge valve assembly for selectively communicating the suction and discharge lines respectively with the compressor cylinder, which unloader method comprises the steps of:

(a) providing an unloader valve assembly with a valve guard, a valve seat having a plurality of seat passages arrayed in a seat passage circle, a plurality of valve members movably mounted on the valve guard in a valve circle and movable between open and closed positions with respect to the seat passages;

(b) rotatably mounting the guard on the valve seat;

(c) generating a signal corresponding to an angular orientation of said compressor crankshaft;

(d) providing a stepper motor;

(e) drivingly connecting said stepper motor to said unloader valve assembly guard;

(f) rotating said valve assembly guard by said stepper motor by an angular increment corresponding to the angular spacing between an adjacent pair of said valve members in response to a revolution of said crankshaft;

(g) rotating said valve guard for each incremental rotation by a first phase corresponding to approximately one-half the angular spacing of said valve members and by a second phase corresponding to approximately one-half the angular spacing between said valve members;

(h) positioning said valve members between respective, adjacent pairs of valve seats with said first rotation phase; and (i) aligning said valve members with respective seat passages adjacent to their previously-aligned seat passages with said second rotation phase.

20. The unloading method according to claim 19, which includes the additional step of:

(a) retaining said valve members in respective unloaded positions during a portion of a compression cycle.

* * * * *